US005832549A

United States Patent [19]

Le Pallec et al.

[11] Patent Number: 5,832,549

[45] Date of Patent: Nov. 10, 1998

[54] BED SIDE PART

[75] Inventors: Didier Le Pallec; Dominique Robic, both of Grand Champ; Richard Borders, Auray, all of France

[73] Assignee: Le Couviour Mobilier specialise sante, Pluvigner, France

[21] Appl. No.: 769,219

[22] Filed: Dec. 18, 1996

[30] Foreign Application Priority Data

Dec. 18, 1995 [EP] European Pat. Off. ..... 95119930

[51] Int. Cl.[6] ..... A47C 21/08

[52] U.S. Cl. ..... 5/430; 5/428; 5/429

[58] Field of Search ..... 5/425, 428, 429, 5/430, 662

[56] References Cited

U.S. PATENT DOCUMENTS

| | | | |
|---|---|---|---|
| 1,938,635 | 12/1933 | North . | |
| 2,014,205 | 9/1935 | Linden . | |
| 3,029,447 | 4/1962 | Maertins . | |
| 3,055,020 | 9/1962 | Mann | 5/430 |
| 3,336,609 | 8/1967 | Taylor | 5/430 |
| 3,548,426 | 12/1970 | Helton . | |
| 3,604,024 | 9/1971 | Polanski | 5/430 |
| 3,851,345 | 12/1974 | Benoit et al. | 5/430 |
| 4,702,176 | 10/1987 | Goshow . | |
| 4,771,492 | 9/1988 | Paine et al. . | |
| 5,463,784 | 11/1995 | Alpern | 5/430 |

FOREIGN PATENT DOCUMENTS

| | | |
|---|---|---|
| 68 12 695 | 5/1969 | Germany . |
| 84 12 948.4 | 8/1984 | Germany . |
| 34 34 955 C1 | 3/1986 | Germany . |
| 25 38 708 C2 | 1/1987 | Germany . |
| 35 40 723 C1 | 2/1987 | Germany . |
| 85 32 458.2 | 2/1987 | Germany . |
| 35 36 499 C2 | 7/1987 | Germany . |
| 87 00 804.1 | 7/1987 | Germany . |
| 90 16 422.9 | 4/1991 | Germany . |
| 44 00 802 A1 | 7/1995 | Germany . |
| 44 16 689 C1 | 6/1996 | Germany . |

OTHER PUBLICATIONS

Brochure: Catalog 45 "the Paramount Bed Represents a Merging of High–Technology Functions with the need of Patients and Medical Professionals", Paramount Bed.

Brochure: "670 Acute Care Hospital Bed—How You Have a Choice", Joerns Surnrise Medical, Wisconsin, USA 1987.

Brouchure: "24 Hours a Day—Wissner Hospital Supplies", Wissner GmbH, Wickede.

Brochure: "The New Protective Lattice—Telerail—The Essential Aid for Modern Patient Treatment", T.M.V. Hilversum B.V Temfa Krankenhausmöbel, Hilversum, Netherlands.

Brochure: "Trevillton—New Lateral and Longitudinal Patient Transfer System", Trevillton Ltd., Caerphilly, U.K.

Brochure: "Ripose Nursing Home Bed", Riposa Recticel AG, Affoltern a.A., Switzerland.

Brochure: "ALOES Intersive Care Beds", from Oetiker® Hans Oetiker Metallwaren und Apparatefabrik GmbH, Endingen, (List continued on next page.)

*Primary Examiner*—Michael F. Trettel

*Attorney, Agent, or Firm*—Antonelli, Terry, Stout & Kraus, LLP

[57] ABSTRACT

The invention relates to a bed side part for beds, especially for hospital and nursing home beds, with bed side parts mounted on the long sides, with said parts extending over the entire or approximately the entire length of the beds in question, hospital beds for example. As usual, the bed side parts are bringable at least into a raised position and into a completely depressed position, but are also preferably lockable in intermediate positions. Locking can also be performed with inclination, in other words the end areas of the bed side part in question can be lockable at different heights. According to the invention, a protective side part is associated with the bed side part and can be caused to function especially when the bed side part is completely depressed, in other words it protects the lengthwise portion of the patient at the head end.

15 Claims, 3 Drawing Sheets

OTHER PUBLICATIONS

Brochure: "Accident & Emergency Trolleys", J. Nesbit Evans & Co., Ltd., West Midlands, England.
Brochure: "Model No. Y 2872", Hoskins & Sewell Ltd., Birmingham, England.
Brochure: "Oostwoud® Hospital Beds", Opticare 3760, 3780.
Brochure: "Clinicomfort: Optimaal Gemak Voor Patient en Verpleging", 226, Oostwoud® International b.v., Veenendaal, Netherlands.
Brochure: "K.F. International Bedstead 9557—A Great Advance in Patient Care", Hoskins Limited, Birmingham, England.
Brochure: "Letto di Rianimazione [Intensive Care Bed]", Industrie Guido Malvestio S.p.A., Padua, Italy.
Brochure: "Hospital Beds—Equipment for the Hospital, Old Age Home and Nursing Home, Rehabilitation", A. Johnson & Co., GmbH, Hamburg.
Brochure: "Temsafe Side Lattices", Stryker Medical, Uden, Netherlands.
Brochure: "Stryker Hospital Bed", Stryker Deutschland GmbH, Ratingen.
Brochure: "Hospital Furniture—Stable—Proven—Economical", Standard International Europe GmbH, Krefeld.
Brochure: "Simmons 175 Series", Simmons, Charlotte, USA.
Brochure: "ALOES Special Nursing Home Bed", Oetiker® Hans Oetiker Metallwaren und Apparatefabrik GmbH, Endingen.
Brochure: "Nesbit Evans—Safety Side Accessories and Orthopaedic Fittings—The King's Fund and Profiling Ranges of Beds", J. Nesbit Evans & Co., Ltd., West Midlands, England.
Brochure: "Missaglia Hospital Equipments—Process 80".
Brochure: "Merivaara—Accessories for Hospital Beds", Merivaara, Lahti, Finland.
Brochure: "Hospital Furniture—Krankenhausmöbel—Beds—Betten", Joseph Mertens International, Morsel, Belgium.
Brochure: "Barella/Letto 535 Per Sale di Recupero, Tipo Accessorata e Personalizzata [Barella/Bed 535 for Recovery Rooms, Accesorized & Personalized Type]", Midmark Corp., Versailles, Indiana, USA.
Brochure: "Lit de Reanimation [Intensive Care Bed]", Le Lit de Tou Soins, Paris, France.
Brochure: tt Bett, Patient und Personal–freundlich [tt Bed, Patient and Caregiver–Friendly], Einar Jensen & Son A/S, Ronne, Denmark.
Brochure: "Hospital Beds—FRED®—Flexibility, Reliability, Economy, Design", from InterRoyal Corp., New York, USA.
Brochure: "Hausted® Patient Handling Equipment", Hausted, Ohio, USA.
Brochure: "Flex Float—A Hydrothermic Support System", Ultra Therm, Garden Grove, USA.
Brochure: "EC Hospital Bed with Four–Part Lying Surface, Patient and Caregiver–Friendly", EC Betten Systeme GmbH.
Brochure: "Hospital Furniture", Embru–Werke, Rüti, Switzerland.
Brochure: "Unicon Accessories with Built–in Interchangeability", Ellison Hospital Equipment, Ltd., West Midlands, England.
Brochure: "Doctor's Aid Medical Hospital Beds", Dominion Metalware Industries Ltd., Ontario, Canada.
Brochure: "Das Egerton Paragon 9000 Drehbett", Sacon Deutschland GmbH, Walldorf.
Brochure: "Patient Care Made Easy by Lumex Aids", Johannes Drescher, Düsseldorf.
Brochure: "Monotrol® II Quick and Easy Bed Positioning", Joerns Sunrise Medical, Wisconsin, USA.
Brochure: "Hospital Bed 510—Krarkenbett 510", Oy Finnbrass Ab, Jävenpää, Finland.
Brochure: "Biexo—Factory Medicals Scientifics Surgicals Instruments", Bros N. Chatzioannidis Co., Thessalonica, Greece.
Brochure: "A Condensated Catalog of Furnishings for Health–Care Institutions from Borg Warner—12345", Borg Warner Health Products, Inc.
Brochure: "Clinicomfort: A Clear Relief for Patient and Caregiver—226", BMT Buck Medizintechnik GmbH, Pinnow.
Brochure: "Electric Bed", Bertec Medical, Montreal, Canada.
Brochure: Hospitals Products—Catalog No. 165, Borg–Warner Ingersoll Products, Chicago, USA.
Brochure: "Pflegebett PBS 200 Automatic", Bosserhoff Objekte, Delbrück.

BED SIDE PART

The invention relates to a bed side part for beds, especially for hospital and nursing home beds.

Bed side parts, especially for hospital beds, are already known in a variety of designs. Bed side parts with elements that can be pivoted scissorwise up and down in a plane are already known from Catalog 45, "The Paramount bed represents a merging of high-technology functions with the needs of patients and medical professionals" and the subtitle "Paramount Bed" so that this bed side part can be moved firstly into its uppermost, fully unfolded position and into a lower, depressed position that allows free access to the bed lying surface. The bed side part then extends over practically the entire length of the lying surface.

However, bed side parts are also known from the same catalog that extend over only a portion, preferably the head end, of the bed in question, while the other portion remains unprotected and open. A section of the bed side part in question is designed to be bent at right angles outward and made rigid so that handicapped persons in particular can use this part as a handle when getting up and can also straighten up as they get out of the bed.

A design is also known from this publication in which the bed side part that pivots up and down scissorwise consists of a plurality of lengthwise sections that allow free access to the lying surface at the foot and head ends. In this connection, it is also proposed to provide a bent tubular frame on a side area next to a bed side part that pivots up and down scissorwise and can be used as a handle by a handicapped or elderly person. In this case, a space is provided between the various bed side partial sections, with the areas at the head and foot ends being made larger.

A bed, especially a hospital and/or nursing home bed, is known from DE-OS 44 00 802 and consists of a bed frame in which a preferably adjustable lying insert or lying frame is disposed, and a frame supporting the lying frame, with the bed frame having at least one integrated safety side part that is bringable into elevated and depressed positions. In order to improve a bed of this kind, the safety side part has a plurality of cross members, each having one end pivotably mounted on the bed frame and the other end connected with articulation to a lengthwise member. As a result, the bed side part, as in the bed parts described above, can be pivoted up and down in the vertical plane, in other words into an upper locked position that blocks free access to the bed and a depressed position that allows free access to the lying surface.

DE-GM 90 16 422.9 teaches a bed, especially a patient and/or nursing home bed, with board-shaped sections mounted laterally, said sections leaving gaps between them and forming the bed side part. The bed side part is likewise mounted so that it can be locked in upper and lower positions.

A similar bed is known from DE-GM 87 00 804.1, in which the side part has a foldable wall located between an upper and a lower tube or corresponding cross members. The cross members are guided slidably in side guides of the corner members in such fashion that the upper cross member can be raised over the entire height of the guide or length of the guide and the lower cross member is movable only in a partial section of this guide, with a stop or lock that limits the movement of the lower cross member being located in this guide, and the upper cross member is coupled in its movement with the lower cross member by the foldable wall.

DE-GM 85 32 458 and DE-PS 35 40 723 likewise teach a hospital and/or nursing home bed, with the side parts being attached to the bed edge in such fashion that the movable side part is located in a vertical plane that runs through the lengthwise member of the lying surface frame and therefore there are no parts that project laterally. Guide means are provided for the movable side parts and are formed by the four corner members themselves, with the guide slots pointing toward the inner surface of the bed in such fashion that the movable and height-adjustable side part is itself a part of the bed edge and is integrated thereinto.

DE-GM 84 12 948.4 likewise teaches a hospital and/or nursing home bed with a side part designed as a wooden lattice and provided on both sides with a short guide on the upper member and with longer guides on the side edges of the body of the wooden lattice.

A hospital bed is known from DE-PS 35 36 499 in the form of a jointed frame bed with a plurality of lying surface parts connected pivotably with one another to move around parallel axes, said parts supporting the bedding, with a bed side part that can be moved away and has a movable part being provided on at least one side of the bed. The bed side part is designed to be movable with articulation within predetermined length ranges in such fashion that pivoting and/or lifting movements of the lying surface parts cause the associated sections of the side part to join in these movements. For this purpose, the bed side part consists of a plurality of sections which, like the lying surface parts, are connected with one another with articulation. Here again the bed side part extends over the entire length of the bed.

A hospital and/or nursing home bed is likewise known from the brochure "670 Acute Care Hospital Bed—Now you have a choice" from Joerns Sunrise Medical, Stephens Point, Wis., 1987, in which bed, on both sides of said bed, bed side parts each extending over a portion of the length of the bed are provided, said parts consisting of parallel tube sections and tube sections connecting them vertically. The bed side parts are designed so that they can be folded downward individually and project into the space formed between the surface on which the bed stands and the underside of the bed.

Various bed side parts are known from the brochure of Wissner GmbH, Wickede, "24 hours a day—Wissner Hospital Supplies." Some of these previously known bed side parts consist of tubes arranged parallel to one another with spaces between them, said tubes being fastened to vertical tubes. Other designs consist of lattice-type elements.

A similar design is known from the brochure "The New Protective Lattice—Telerail—The Essential Aid in Modern Patient Treatment" (subsequently Patent P 26 20 529.8), with the lattice also being lowerable on one side, with the tubes running at acute angles to one another and on top of one another. The tubes can also be lowered, however, so that they rest on top of one another.

Side lattices that can fold down are known from the brochure "Trevillton—New Lateral and Longitudinal Patient Transfer System" from Trevillton Ltd., Caerphilly, U.K., which also extend over the entire length of the lying surface.

Side lattices consisting of tubes are also shown in a brochure from Stryker Medical. Several designs extend over only a portion of the length while others extend over the entire length.

Side lattices consisting of textile nets framed in tubular frames are known for example from the brochure "Riposa Nursing Home Bed" from Riposa Recticel AG, Affoltern a.A., Switzerland.

ALOES describes so-called "intensive care beds" whose lying surfaces have associated with them a plurality of relatively short bed side parts composed of tubes arranged parallel to one another.

In the brochure from Nesbit Evans "Accident & Emergency Trolleys" intensive care beds are described in which bed side parts composed of three tubes are shown and described, with the lower tubes being located in tubular sleeves following multiple bends, said sleeves being fastened laterally to the mattress frame, in which sleeves the bent tube sections are so mounted so that they can move by sliding in order thereby to lock the bed side part at various heights. Clamping screws are associated with the tubular sleeves. In the lower, depressed position of the bed side part and the lying surface frame, the free, bent tubular sections used to guide and fasten the bed side part practically rest on the surface on which the bed stands.

Bed side parts guided through tubular sleeves on vertical columns for the bed heads, consisting of a rigid lattice, are also known from a brochure from Hoskins & Sewell Ltd., for example Model Number Y 2872. In the lower position, the lowered side part completely blocks the free space below the mattress area and the floor, so that nothing can be set up, x-rayed, or placed thereunder.

The goal of the invention is to design in an inventive fashion a bed side part of the species recited at the outset in such fashion that, firstly, protection for the person in the bed is ensured over the full length of the bed by the bed side part, and, secondly, the advantages gained by lowering the bed side part, for caregivers for example, can be retained while the person occupying the bed, possibly for days at a time, can be reliably protected against falling out, while simultaneously being able to get in and out of bed easily.

This goal is achieved by the features in claim 1.

In this design of the invention, each bed side is protected by a bed side part that is completely lowerable as usual but also can be locked in an upper locking position and in an intermediate position. This bed side part as a rule is used at night or if the patient has just had surgery, for example. However, the additional, considerably smaller, and especially shorter protective side part provides the advantage that the large, long bed side part can be left down during the day for example so that not only do the caregivers have good access to the patient from the side in order to perform treatment but also, when the bed side parts have been completely lowered, the patient is still protected by the protective side part from accidentally falling out of bed, for example when asleep in the daytime. In addition, the patient, thanks to the special arrangement of the protective side part, can use the latter as a handle, for example when getting up and leaving the bed, but also when getting in again. However, he can also stow this protective side part completely after he gets up, just like the other side part of the bed, so that the lying surface is fully accessible over its entire length. Therefore, in the invention a conventional bed side part is "combined" in logical fashion with a protective side part. This protective side part need extend only over a certain portion of the length, for example over only one-third of the length of the lying surface. In any event, it should have a length such that the person occupying the bed can get up unaided by grasping the protective side part and supporting himself on the protective side part to assume a sitting position for example, whereupon the patient, continuing to support himself on the protective side part for example, can also get up in order to walk around in the room for example. When he sits down again on the bed, the patient can support himself on the protective side part and gradually swing his feet up. The protective side part then protects him from falling over sideways.

Normally this protective side part does not interfere with the caregivers and the physician since it extends over only a part of the length of the bed, so that treatments of the legs or lower body, possibly also in the abdominal area, can be performed without difficulty. However, if the entire length and thus completely free access to the lying surface should be required, the protective side part can be stowed quickly and conveniently, with a twist of the wrist so to speak, by pivoting it downward for example.

If the long bed side part is in use, especially at night, the protective side part is not functional.

The bed side part can have practically any desired design and can consist for example of tubes running parallel, a lattice made of elements moved scissorwise, webs of material, or the like.

In the embodiment according to claim 2 the protective side part is mounted on the bed side part and therefore forms a part that is added to the bed side part that is bringable into and out of function and can even be removed for example.

On the other hand, the protective side part in the embodiment according to claim 3 is integrated into the bed side part itself, for example by virtue of the fact that a part of the bed side part, after being completely lowered, is pivoted upward, folded upward, pulled upward, or moved upward scissorwise. For example, in the vicinity of the head and of the bed side part, the protective side part can be so designed that the bed side part on this side is designed with double walls in such fashion that a portion of this double-walled or double construction forms the protective side part that is raised into its functional position after the bed side part is lowered.

The protective side part can also be disposed in a member of the bed side part, telescopewise for example. When it is used, it is pulled out laterally and/or upward and moved upward and then fastened at the head of the bed to a post on the bed side part or the like. A web of material, a net, or other links that are articulated or flexible, such as telescoping stubs, linking elements, or the like then bridge the space between an upper portion of the protective side part and the lowered upper member of the bed side part or the like.

An especially advantageous embodiment is described in claim 4. In this embodiment, both the bed side part and its elements as well as the protective side part and its elements can be moved toward or against one another in such fashion that they end up practically inside the lateral projection of the lying surface frame and/or the bedding and thus do not prevent free access between the floor and the underside of the lying surface frame.

According to claim 5 the protective side part has a lower and an upper member that are connected together with articulation by links in such fashion that the upper member and its links are pivotably movable in the vertical plane and are lockable in the upper position.

In the embodiment according to claim 6 the links and/or the upper members of the protective side part are designed as tubular sections while in the embodiment according to claim 7 the upper member and links are designed as tubes that are circular in cross section.

On the other hand, in the embodiment according to claim 8 the links are designed as rods.

The embodiment according to claim 9 on the other hand uses linking elements that are movable scissorwise with respect to one another, said elements wholly or partially filling the space between the upper and bottom members when the protective side part is in the upper position.

Another advantageous embodiment is described in claim 10. In this claim, the links and/or the members are designed so that they are movable and can telescope into one another.

Yet another advantageous and inventive embodiment is described in claim 11. In this claim, the upper member of the bed side part is provided in its central lengthwise area with a recess into which the upper member of the protective side part can be pivoted wholly or partially in the lowered position.

Claim 12 describes an inventive embodiment. In this embodiment, the upper member is designed as a telescoping tube with its end in the shape of a handle and permitting a design with especially few individual parts. The individual parts, by the advantageous connection of these parts during complete lowering of the protective lattice, can be located in the lateral projection in such fashion that they do not impede free access to the lying surface in any way. The articulation of the one telescopic arm of the upper member is located on the bed side part or the like, so that in an emergency, rapid access to the patient is also provided in the head area because the protective side part does not pose a problem in this area when in its fully erected position. Nevertheless, by virtue of the special design of this protective side part, there is no risk of the patient accidentally falling out of bed since the head, due to its relatively small weight by comparison with the rest of the body, is not able to move the body out of the bed if the patient is unconscious or asleep. There is also no danger of pinching the extremities since adjusting the height of the bed moves the protective side part and the bed side part along with it.

An especially advantageous embodiment is described in claim 13.

The invention is shown partially schematically in the drawing.

Figure 4:
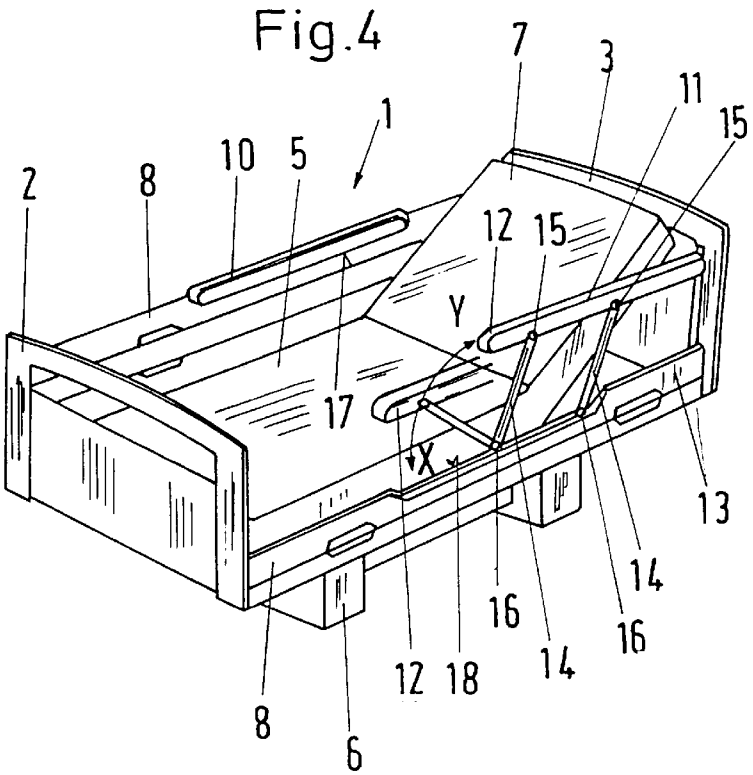
FIG. 4 shows the hospital bed shown in FIG. 3 in a perspective view.

Reference number 1 refers in general to a bed designed as a hospital and/or nursing home bed that can have a conventional design. Bed 1 has a footboard 2 at the foot and a headboard 3 at the head, while 4 refers to a lying surface frame now shown in detail (FIG. 1) on which bedding 5 is located.

Lying surface frame 4, as partially shown in the drawing and can be raised and lowered and placed at various angular positions at the head and foot by tilting and can also be made lockable in the desired tilted and/or raised positions. Motor drives for this purpose including the linking rods are not shown in detail. Instead, a base part 6 is merely shown schematically. This base part 6 is made rigid in this case so that the bed shown cannot be moved about. However, in a modification, the bed can also be provided with casters of which at least one can be braked to lock it. It is also possible to cover the base parts as shown in FIG. 4 completely or partially with wood and/or plastic and/or sheet metal. Within the framework of the idea of the invention however there are also beds in which the underframes usually found in hospital and/or nursing home beds are employed, housing for example foot pumps, pumps to drive linear motors or electric motors for raising and lowering the lying surface frame, for tilt adjustment, gas springs for reinforcing lying surface parts, for example during the adjusting motion of a backrest 7 and the like.

On both lengthwise sides of bed 1, bed side parts 8 are shown, one of which is shown in its uppermost locked position and the other in its lower depressed position, in which it allows free access to patient 9.

In the embodiment shown, both bed side parts 8 each have a protective side part 10 or 11 associated with them. Each of these protective side parts 10 and/or 11, in the embodiment shown in FIGS. 1 to 4, has an upper member 12 while the lower member of protective side part 10 or 11 can be formed by the respective lower member of bed side part 10 or 11 in question, but this is not necessary. It is also possible to provide an additional lower lengthwise member for the protective side part. For reasons of simplicity, only lower member 13 has been given a reference number. Each of upper members 12 is coupled with lower member 13 by a plurality of links 14 that are coupled pivotably by horizontal and parallel axes 15 and 16 with corresponding members 12 and 13 so they can move in the vertical plane. Double arrow X or Y shows the upward and downward pivoting of the protective side part 11 in question.

Figure 1:
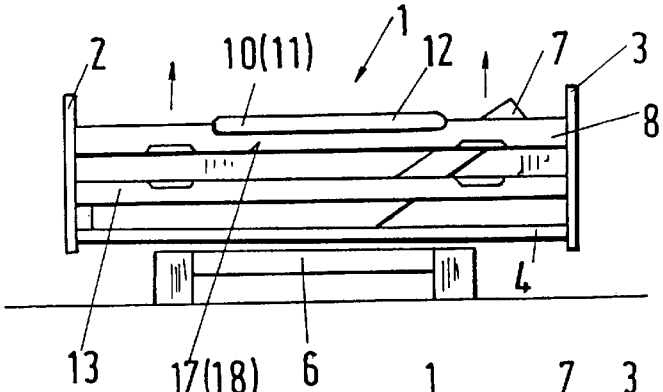
FIG. 1 is a side view of a nursing home and/or hospital bed according to the invention, with the bed side parts in the raised position and with the protective side part in its inactive position.
Figure 2:
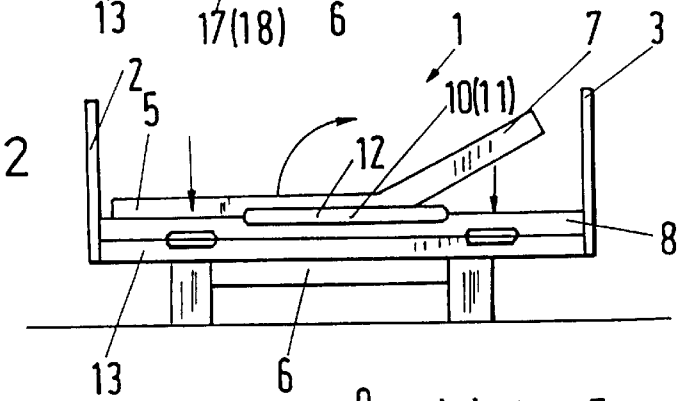
FIG. 2 shows the bed shown in FIG. 1 with the bed side part lowered into the depressed position and the protective side part likewise in the inactive position.

Lower member 13 of each bed side part 8 is provided in its central lengthwise area with a recess 17 or 18 that matches upper member 12 of protective side parts 10 and 11, into which recess the respective upper member of the protective side part 8 in question can be pivoted inward completely or partially. As indicated in FIGS. 1 and 2, the protective side part 10 or 11 in question then does not project at all or only to a slight extent beyond the upper edge of upper member 12 of side part 8 in question so that the protective side part does not interfere visually or form edges in this position.

Figure 3:
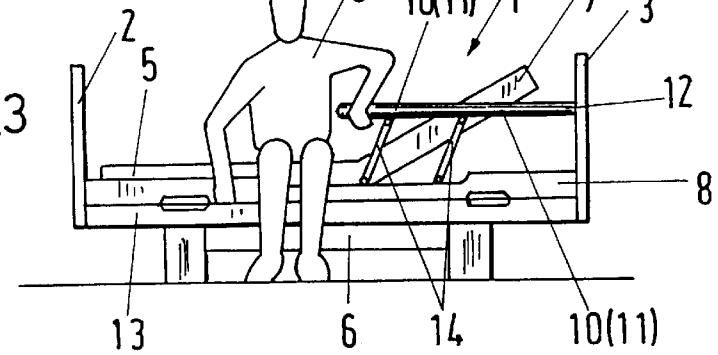
FIG. 3 shows a position of the lying surface frame according to FIG. 2 with the protective side part in its upper position and with the patient shown in a sitting position in the process of getting out of the hospital bed himself.

With bed side part 8 lowered, protective side part 10 or 11 can be pivoted upward into its position shown in FIGS. 3 and 4, with the lengthwise section of member 12 that points toward the central lengthwise section of bed 1 possibly serving as a handle for patient 9. For example, when leaving the bed (FIG. 3) he can support himself on this lengthwise section of upper member 12 and can also climb back into bed the same way. As can be seen, the head area is protected by the protective side part while the actual bed side part 8 is completely lowered. During the day for example, only protective side part 10 or 11 can be brought into its functional position in this manner, giving the caregivers almost completely free access to the patient while the latter is nevertheless protected. In addition, the patient is spared the impression of being in a cage. At night the bed side parts 8 that extend lengthwise can be raised into their elevated positions, while protective side parts 10 and 11 are brought into their inactive positions as shown in FIGS. 1 and 2.

Figure 5:
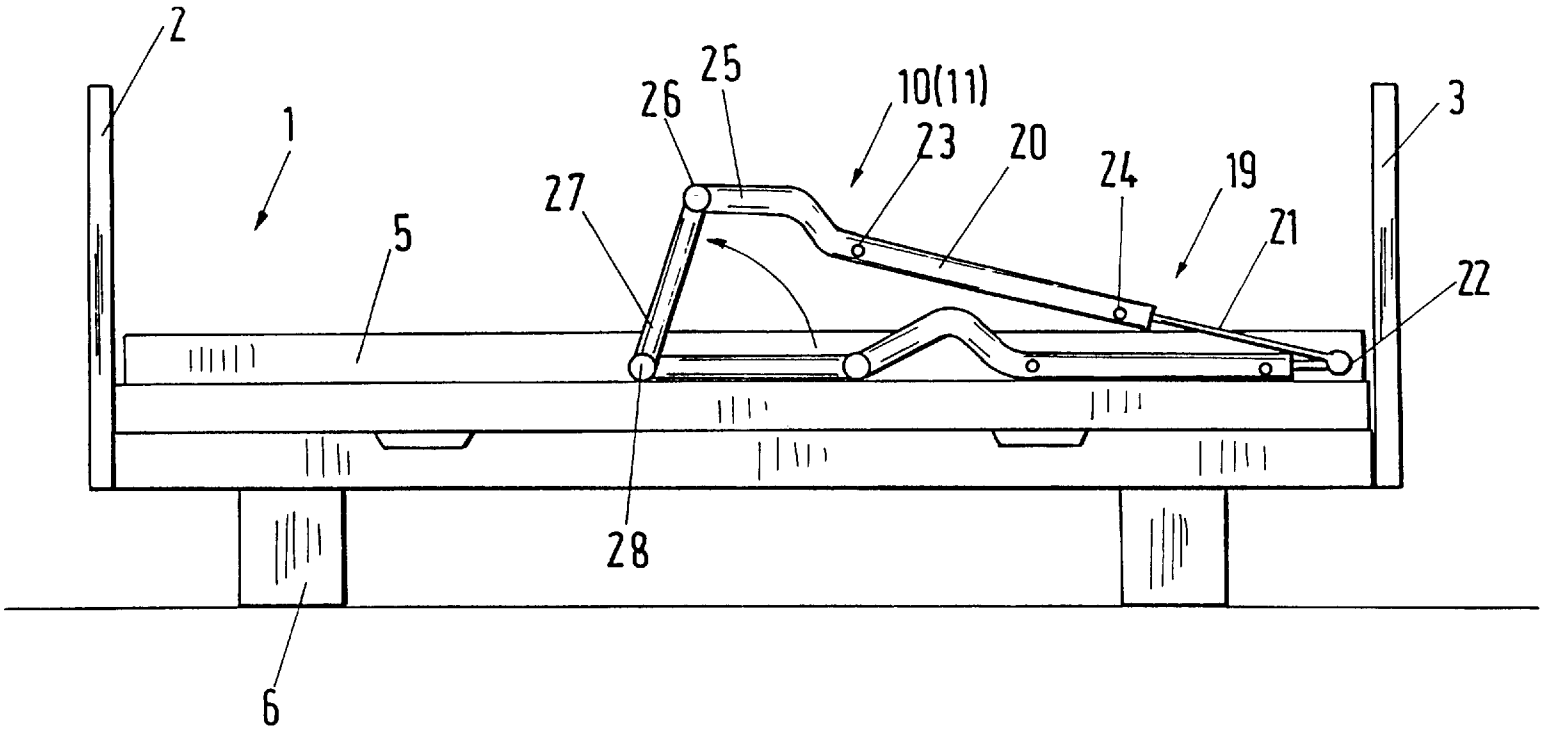
FIG. 5 shows another embodiment of the invention, likewise in a side view of a bed with the bed side part lowered and the protective side part pivoted upward.
Figure 9:
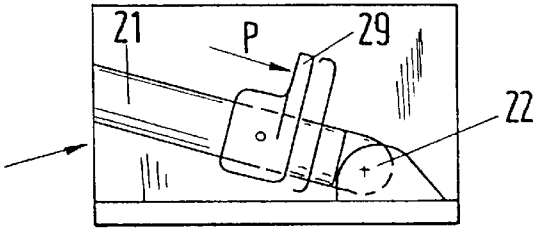
FIG. 9 shows a detail of FIG. 6 on an enlarged scale and partially cut away.
Figure 8:
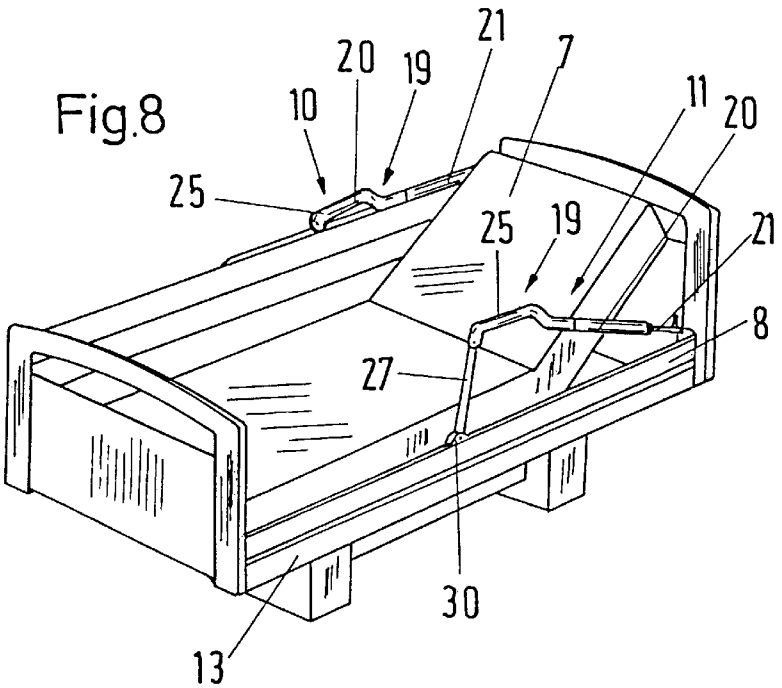
FIG. 8 shows the nursing home and/or hospital bed shown in FIGS. 6 and 7 in a perspective view, with the rear bed side part in the raised position and the front bed side part in the lowered position, with the protective side parts in the raised position.
Figure 6:
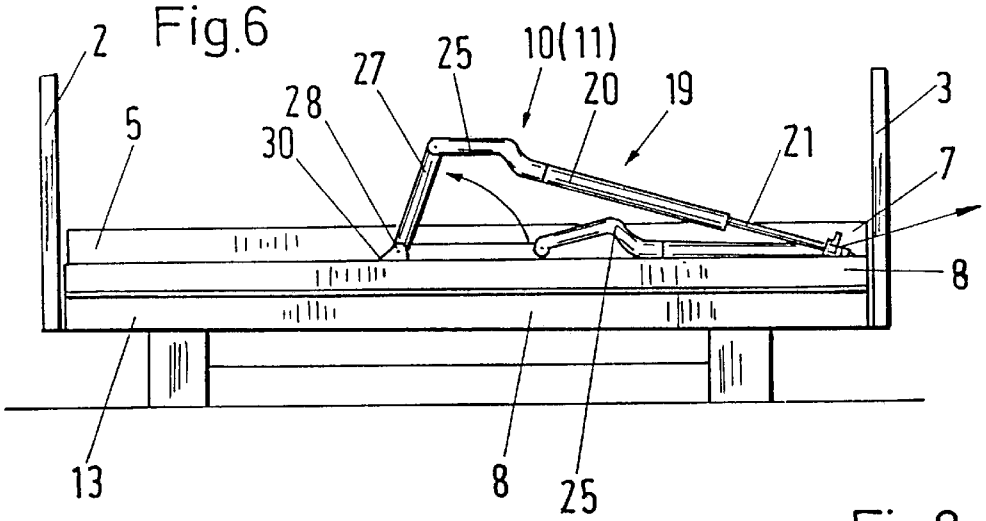
FIG. 6 shows a nursing home and/or hospital bed in another embodiment, likewise in a side view, with the bed side part lowered.
Figure 7:
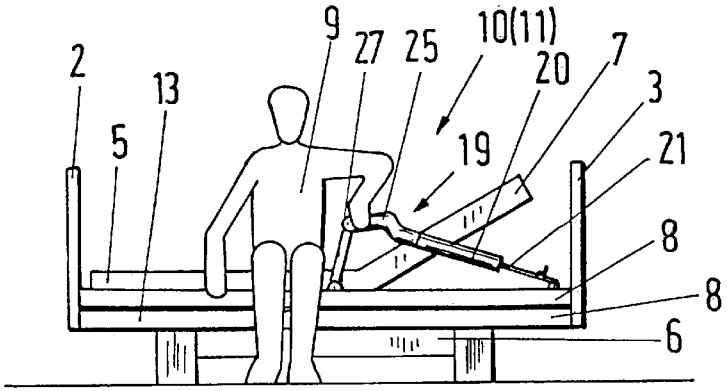
FIG. 7 shows the hospital bed shown in FIG. 6 with the bed side part lowered and the lying surface frame in the lower position.

In the embodiment according to FIG. 5, the same reference numbers have been used for parts with the same functions. In this embodiment, upper member 19 is composed of two or more lengthwise-adjustable tubular sections 20 and 21 that can telescope into one another, with tubular section 21 being mounted so that it can move pivotably in the vertical plane on a pivot axis 22 located on a part of bed side part 8 or the like in question. Outer tubular section 20, which has a larger diameter, has a plurality of adjusting buttons 23, 24 that cooperate with snaps. In many cases, only one adjusting button, 24 for example, is sufficient to actuate the snaps. In this manner it is possible to pivot the protective side parts 10 and 11 in question into different positions heightwise. It is also possible to provide teeth or the like instead in order to be able to adjust and lock the tubular sections with respect to one another.

At its free end section, tubular section 20 is provided with a handle 25 that can be molded and which allows patient 9 to grip it in order to raise himself or to lower himself slowly again on the edge of the bed. In this area a pivot axis 26 and a link 27 are also provided and are mounted pivotably by means of a pivot axis 28, located for example on bed side part 8, so they can move in the vertical plane. In the lower position, the protective side part 10 or 11 is shown in its depressed position in which handle 25 does not project at all or only within a small area over the upper edge of the bedding. Of course, the arrangement can be made such that it does not project at all over the lateral projection of the bedding and/or mattress frame 4, in other words it does not interfere at all. Instead of being located on bed side 8, pivot axes 22 and 28 can also be mounted on bed side part 8 on its guide or projections. In the upper position of the bed side part 8 in question, protective side part 10, 11 is pivoted downward.

In a modification of these embodiments, one or the other protective side part 10, 11 can also be locked in intermediate heightwise positions of bed side part 8, possibly at different heightwise positions at each end, in the raised or lowered position, or at intermediate height positions.

In FIGS. 6 to 9 another embodiment of the invention is shown, used on a hospital and/or nursing home bed, so that the same reference numbers have been used for parts with the same functions. In this embodiment, upper member 19 is likewise composed of two or more lengthwise-adjustable tubular sections 20 and 21 that can telescope into one another, but with tubular section 21 being mounted pivotably on a pivot axis 22 (FIG. 9) on a part of the corresponding bed side part 8 or the like so it can move in the vertical plane. Outer tube section 20 which is larger in diameter has a release button 29 (FIG. 9) to release protective side parts 10 or 11 so they can be pivoted upward or downward or locked in intermediate positions after releasing the button. For this purpose, a force is exerted in direction P on release button 29.

Tubular section 20 with the larger diameter is associated with a handle 25 on which patient 9 can support himself and which he can grip. Handle 25 can be made integral with tubular section 20. As can be seen, link 27 is mounted to be pivotably movable in the vertical plane on pivot axis 28, once again for example on bed side part 8, especially by means of an angle or bearing 30. In this embodiment as well, link 27 of the corresponding protective side part 10 or 11 in the lowered position is parallel to or approximately parallel to the bed side part 8 in question within the lateral projection of the lying surface frame or bedding. In this case, handle 25 is designed so that in the lateral projection, it is located below the lying surface frame or at least below the bedding that is on the lying surface frame and does not cause any interference.

The features described in the abstract, claims, and specification and shown in the drawing can be important both individually and in any combination to the working of the invention.

| List of Reference Numbers | |
|---|---|
| 1. | Hospital bed, nursing home bed, bed |
| 2. | Bed head, foot end |
| 3. | Bed head, head end |
| 4. | Lying surface frame, mattress frame |
| 5. | Bedding |
| 6. | Foot |
| 7. | Backrest |
| 8. | Bed side part |
| 9. | Patient |
| 10. | Protective side part |
| 11. | " |
| 12. | Member, upper |
| 13. | Member, lower |
| 14. | Link |
| 15. | Axis |
| 16. | " |
| 17. | Recess |
| 18. | " |
| 19. | Member, upper |
| 20. | Tubular section |
| 21. | " |
| 22. | Pivot axis |
| 23. | Adjusting button |
| 24. | " |
| 25. | Handle |
| 26. | Pivot axis |
| 27. | Link |
| 28. | Pivot axis |
| 29. | Release button |
| 30. | Angle, bearing |
| X. | Pivot direction |
| Y. | " |
| P. | Direction of application of force to release button 29 |

LIST OF REFERENCES

Brochure: Catalog 45 "The Paramount Bed Represents a Merging of High-Technology Functions with the Needs of Patients and Medical Professionals", Paramount Bed Brochure: "670 Acute Care Hospital Bed—Now you have a choice," from Joerns Sunrise Medical, Wisconsin, USA, 1987

Brochure: "24 Hours a Day—Wissner Hospital Supplies," from Wissner GmbH, Wickede Brochure: "The New Protective Lattice—Telerail—The Essential Aid for Modern Patient Treatment," from T. M. V. Hilversum B. V. Temfa Krankenhausmöbel, Hilversum, Netherlands Brochure: "Trevillton—New Lateral and Longitudinal Patient Transfer System," from Trevillton Ltd., Caerphilly, U.K.

Brochure: "Riposa Nursing Home Bed," from Riposa Recticel AG, Affoltern a.A., Switzerland Brochure: "ALOES Intensive Care Beds," from Oetiker® Hans Oetiker Metallwaren und Apparatefabrik GmbH, Endingen Brochure: "Accident & Emergency Trolleys," from J. Nesbit Evans & Co., Ltd., West Midlands, England Brochure: "Model No. Y 2872", Hoskins & Sewell Ltd., Birmingham, England Brochure: "oostwoud® Hospital Beds, opticare 3760,3780

Brochure: "Clinicomfort: Optimaal gemak voor patient en verpleging," 226, oostwoud® international b.v., Veenendaal, Netherlands Brochure: "K.F. International Bedstead 9557 —A Great Advance in Patient Care, Hoskins Limited, Birmingham, England Brochure: "Letto di rianimazione (Intensive Care Bed)" from Industrie Guido Malvestio S.p.A., Padua, Italy
Brochure: "Hospital Beds—Equipment for the Hospital, Old Age Home. and Nursing Home, Rehabilitation," from A. Johnson & Co. GmbH, Hamburg
Brochure: "Temsafe Side Lattices," from Stryker Medical, Uden, Netherlands
Brochure: "Stryker Hospital Bed", Stryker Deutschland GmbH, Ratingen
Brochure: "Hospital Furniture—Stable—Proven—Economical," from Standard International Europe GmbH, Krefeld
Brochure: "Simmons 175 Series," Simmons, Charlotte, USA
Brochure: "ALOES Special Nursing Home Bed", Oetiker® Hans Oetiker Metallwaren und Apparatefabrik GmbH, Endingen
Brochure: "Nesbit Evans—Safety Sides Accessories and Orthopaedic Fittings—The King's fund and Profiling Ranges of Beds", J. Nesbit Evans & Co. Ltd., West Midlands, England
Brochure: "Missaglia Hospital Equipments—Progress 80"
Brochure: Merivaara—Accessories for Hospital Beds", Merivaara, Lahti, Finland
Brochure: Hospital Furniture—Krankenhausmöbel—Beds—Betten", Joseph Mertens International, Morsel, Belgium
Brochure: "Barella/Letto 535 per sale di recupero, tipo accessorata e personalizzata [Barella/Bed 535 for Recovery Rooms, Accessorized and Personalized Type]," from Midmark Corp., Versailles, Ind., USA
Brochure: "Lit de reanimation [Intensive Care Bed]," Le Lit de Tous Soins, Paris, France
Brochure: "tt Bett, Patient und Personal-freundlich [tt Bed, Patient- and Caregiver-Friendly]," Einar Jensen & Son A/S, Ronne, Denmark
Brochure: "Hospital Beds—FRED®—Flexibility, Reliability, Economy, Design," from InterRoyal Corp., New York, USA
Brochure: "Hausted® Patient Handling Equipment," from Hausted, Ohio, USA
Brochure: "Flex Float—A Hydrothermic Support System," from Ultra Therm, Garden Grove, USA
Brochure: "EC Hospital Bed with Four-part Lying Surface, Patient- and Caregiver-Friendly," from EC Betten Systeme GmbH
Brochure: "Hospital Furniture", Embru-Werke, Rüti, Switzerland
Brochure: "Unicon Accessories with Built-in Interchangeability," from Ellison Hospital Equipment Ltd., West Midlands, England
Brochure: "Doctor's Aid Medical Hospital Beds," from Dominion Metalware Industries Ltd., Ontario, Canada
Brochure: "Das Egerton Paragon 9000 Drehbett," from Sacon Deutschland GmbH, Walldorf
Brochure: "Patient Care Made Easy by Lumex Aids," from Johannes Drescher, Dusseldorf
Brochure: "Monotrol® II Quick and Easy Bed Positioning," from Joerns Sunrise Medical, Wisconsin, USA
Brochure: "Hospital Bed 510—Krankenbett 510," from Oy Finnbrass Ab, Jävenpää, Finland
Brochure: "Biexo—Factory Medicals Scientifices Surgicals Instruments," from Bros N. Chatzioannidis Co., Thessalonica, Greece
Brochure: "A Condensated Catalog of Furnishing for Health-Care Institutions from Borg Warner—12345," from Borg Warner Health Products, Inc.
Brochure: "Clinicomfort: A Clear Relief for Patient and Caregiver—226," from BMT Buck Medizintechnik GmbH, Pinnow
Brochure: "Electric Bed," from Bertec Medical, Montreal, Canada
Brochure: "Hospital Products—Catalog No. 165," from Borg Warner Ingersoll Products, Chicago, USA
Brochure: "Pflegebett PBS 200 Automatic," from Bosserhoff Objekte, Delbrück
DE-OS 44 00 802
DE-PS 25 38 708
DE-PS 34 34 955
DE-PS 35 36 499
DE-PS 35 40 723
DE-PS 44 16 689
DE-GM 68 12 695
DE-GM 84 12 948.4
DE-GM 85 32 458.2
DE-GM 87 00 804.1
DE-GM 90 16 422.9
U.S. Pat. No. 1,938,635
U.S. Pat. No. 2,014,205
U.S. Pat. No. 3,029,447
U.S. Pat. No. 3,055,020
U.S. Pat. No. 4,772,492

What is claimed is:

1. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, wherein each of the first side part and the protective side part can be raised independently, to be able independently to protect the person.

2. Side structure according to claim 1, wherein said furniture is a bed.

3. Side structure according to claim 1 or 2, wherein said uppermost position is a position to protect the person from falling off the furniture.

4. Side structure according to claim 1 or 2, wherein the protective side part is associated with a top of the first side part such that the protective side part can be positioned above a lowermost position thereof when the first side part is at a lowermost position thereof and is positioned adjacent the top of the first side part when the first side part is above its lowermost position.

5. Side structure according to claim 1 or 2, wherein the protective side part is a separate part from the first side part.

6. Side structure according to claim 1 or 2, wherein the protective side part is integrated with the first side part.

7. Side structure according to claim 1 or 2, wherein the furniture includes a frame upon which the person can recline, a space being provided beneath the frame and extending to a base on which the furniture rests, and wherein the first side part and the protective side part at lowermost positions thereof do not enter said space.

8. Side structure according to claim 2, wherein said bed is selected from the group consisting of a hospital bed and a nursing home bed.

9. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, wherein the protective side part includes a top member and a bottom member, said bottom member being adjacent a top of the first side part, the top member being movable to provide the protective side part at an uppermost position thereof, and wherein the top and bottom members respectively are upper and lower stringers, the upper and lower stringers being connected with linking structure.

10. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, and wherein the first side part can be locked at positions intermediate uppermost and lowermost positions thereof, and said protective side part can be locked at positions intermediate uppermost and lowermost positions thereof.

11. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, and wherein the protective side part includes handle structure such that the person can use the protective side part as a handle when getting up from and when getting on the furniture.

12. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, and wherein the first side part has upper and lower members, the upper member having a recess therein, the protective side part also having upper and lower members, the upper member of the protective side part being adapted to fit in the recess of the upper member of the first side part.

13. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, and wherein the protective side part has an upper stringer and links, at least one of the upper stringer and links consisting of tubes that are movable telescopically inside one another.

14. Side structure for furniture on which a person can recline, said side structure extending lengthwise of said furniture, wherein said side structure can be raised to an uppermost position, and lowered to a lowermost position allowing free access to a surface of the furniture on which the person can recline, said side structure including a first side part and a second side part, extending on a same side of the furniture, the second side part being a protective side part and extending lengthwise only a portion of the length of the first side part, wherein the protective side part includes an upper stringer which includes two tubes one of which telescopes into the other, one of the two tubes being pivotally movable around a horizontal pivot axis on one of (a) a frame of the furniture, upon which the person can recline, (b) a guide for the first side part, and (c) on the first side part, and the other of the two tubes being connected by a first pivot axis with a link pivotally movable in a vertical plane by a second pivot axis on the frame or on the first guide part; and wherein the other of the two tubes has a handle.

15. Side structure according to any one of claims 9–12, 13 and 14, wherein said furniture is a bed.

* * * * *